US009687749B2

(12) United States Patent
Zhang

(10) Patent No.: US 9,687,749 B2
(45) Date of Patent: Jun. 27, 2017

(54) TETRADECAHEDRON TOY BLOCK

(71) Applicant: Heng Zhang, Jinan (CN)

(72) Inventor: Heng Zhang, Jinan (CN)

( * ) Notice: Subject to any disclaimer, the term of this patent is extended or adjusted under 35 U.S.C. 154(b) by 0 days.

(21) Appl. No.: 14/400,643

(22) PCT Filed: Sep. 25, 2014

(86) PCT No.: PCT/CN2014/087370
§ 371 (c)(1),
(2) Date: Jul. 19, 2016

(87) PCT Pub. No.: WO2015/043477
PCT Pub. Date: Apr. 2, 2015

(65) Prior Publication Data

US 2016/0367907 A1 Dec. 22, 2016

(30) Foreign Application Priority Data

Sep. 29, 2013 (CN) ..... 2013 1 0453981
Sep. 24, 2014 (CN) ..... 2014 1 0492906

(51) Int. Cl.
*A63H 3/16* (2006.01)
*A63H 17/00* (2006.01)
*A63H 33/08* (2006.01)
*A63H 33/04* (2006.01)

(52) U.S. Cl.
CPC ..... *A63H 33/088* (2013.01); *A63H 3/16* (2013.01); *A63H 17/002* (2013.01); *A63H 33/044* (2013.01); *A63H 33/08* (2013.01)

(58) Field of Classification Search
CPC ..... A63H 33/04; A63H 33/08; A63H 33/046; A63H 33/084; A63H 33/086; Y10T 29/49826
USPC ... 472/85, 92, 109, 120, 121, 122, 124–126; 446/85, 92, 109, 120, 121, 122, 124–126
See application file for complete search history.

(56) References Cited

U.S. PATENT DOCUMENTS 4,238,905 A * 12/1980 MacGraw, II ..... A63H 33/046 276/157 R
7,507,136 B2 * 3/2009 Patton ..... A63H 33/046 335/285
D660,664 S * 5/2012 Hsu ..... D8/25
8,850,683 B2 * 10/2014 Haughey ..... A63H 33/046 29/428

* cited by examiner

*Primary Examiner* — Kien Nguyen
(74) *Attorney, Agent, or Firm* — Oliff PLC

(57) ABSTRACT

A device for one or more toy blocks includes a plurality of main unit bodies. The plurality of main unit bodies may have a same structure, shape and volume. Each of the main unit bodies is a tetradecahedron having six square surfaces and eight regular hexagon surfaces. The six square surfaces may be averagely divided into three groups and eight regular hexagon surfaces may be averagely divided into four groups. Two regular hexagon surfaces in a same group are parallel, and more than two main unit bodies are mutually spliced and/or fixedly connected to constitute a group.

20 Claims, 9 Drawing Sheets

TETRADECAHEDRON TOY BLOCK

CROSS REFERENCE TO RELATED APPLICATIONS

This application is the U.S. national phase application of International application number PCT/CN2014/087370, filed on Sep. 25, 2014, which claims the priority benefit of China Patent Applications No. 201310453981.0, filed on Sep. 29, 2013, and No. 201410492906.X, filed on Sep. 24, 2014, which are hereby incorporated by reference in its entirety.

FIELD OF THE DISCLOSURE

The present disclosure relates to an assembling type toy block and in particular to a tetradecahedron toy block.

BACKGROUND

Existing toy blocks can be used to assemble models in various shapes, such as storied building and robot, to produce unit body components with various dimensions and shapes. The major reasons are described as follows. By only using the existing unit body components, it is merely possible to pile up or assemble models with wider lower part and narrower upper part, such as pyramid. Therefore, the toy blocks in the prior art can only assemble very few kinds of models; so the creativity of children is limited. If only the existing unit body components are used, the assembled models have relatively poor stability and will fall out and collapse upon occurrence of small inclination or shaking. Therefore, the toy blocks in the prior art have no satisfactory entertaining quality and may easily cause frustration feeling to children and to deprive their interest in assembly. However, the components with various shapes required higher processing costs. In addition, the components with various shapes require excessively complex and trivial assembly mode and are difficult for children to start operation, leading to unsatisfactory entertaining quality. Furthermore, special splicing modes are provided among different kinds of components in various shapes so that some components cannot effectively spliced. All the factors will limit the creative thinking of children and also be unfavorable for the intellectual development children and the establishment of their perception of three-dimensional space.

SUMMARY

It is the technical objective of the present disclosure is to provide a tetradecahedron toy block, which can include a kind of granular unit body components. Assembly and fixation can be realized between any two unit body components. Furthermore, the assembly mode is simple and easy to learn, so that the toy block can effectively simulate the interest and creation inspiration of children. Several unit body components in the same shape can be assembled into three-dimensional models in various shapes. Furthermore, it may be feasible to ensure that, all the assembled models, regardless of the models with bigger upper part and smaller lower part, or the unsymmetrical models, can become even firmed and stable. In addition, the toy block of the present disclosure can enable the children to gain the sense of fulfillment in the process of assembly and modeling and have even keen interest, thus greatly improving the space perception and creativity of the children.

The present disclosure may be realized through the following technical solution: a tetradecahedron toy block, characterized in that, the tetradecahedron toy block comprises a plurality of main unit bodies, the plurality of main unit bodies have the same structure, shape and volume, each of the main unit bodies may be a tetradecahedron having six square surfaces and eight regular hexagon surfaces, the six square surfaces are averagely divided into three groups, two square surfaces in the same group are parallel, eight regular hexagon surfaces are averagely divided into four groups, two regular hexagon surfaces in a same group are parallel, more than two main unit bodies are mutually spliced and/or fixedly connected to constitute a group. On each of main unit bodies, a column head may be provided on at least one of square surfaces; on another square surface which may be located on the same axis with the column head, a slot may be provided; the column heads of any two main unit bodies are mutually coordinated with the slot, or the column heads of any two groups of main unit bodies are mutually coordinated with the slot; a component comprising two or more main unit bodies in the same group through connection and fixation may be a combined body.

In order to further realize the objective of the present disclosure, it may be also feasible to adopt the following technical solution: More than four main unit bodies are connected into a group, wherein a locating slot may be enclosed by a central portion where every four main unit bodies are mutually connected, a square hole may be provided in the center of the locating slot, the square hole can be coordinated with any square surface of the main unit bodies, so that the tetradecahedron toy block extends in horizontal or longitudinal direction. A group of main unit bodies are locked and coordinated with one or one group of main unit bodies through the third group or the third main unit body: the first group of or the first main unit bodies are coordinated with the locating slot of the second group of the main unit bodies, the direction of the column heads of the first group of main unit bodies may be vertical to or parallel with the direction of the column heads of the second group of main unit bodies, the third group of or the third main unit bodies are spliced and coordinated with the slot through the column heads, so that the second group of main unit bodies and the third group of or the third main unit bodies are respectively coordinated with the first group of or the first main unit bodies, so as to lock the first group of or the first main unit bodies. The fourth group of or the fourth main unit bodies are spliced and coordinated with the slot through the column heads, the fourth group of or the fourth main unit bodies and the third group of or the third main unit bodies are respectively positioned on both sides of the first group of main unit bodies, the third group of or the third main unit bodies, the fourth group of or the fourth main unit bodies and the second group of main unit bodies are jointly coordinated with the first group of or the first main unit bodies to lock the first group of or the first main unit bodies. Both the first group of main unit bodies and the second group of main unit bodies are double-row six-combined body comprising six main unit bodies, the third group of main unit bodies are single-row two-combined body comprising two main unit bodies, two main unit bodies in the first group of main unit bodies are coordinated with two locating slots of the second group of main unit bodies, the third group of main unit bodies are spliced and coordinated with the second group of main unit bodies, the second group of main unit bodies and the third group of main unit bodies lock the first group of main unit bodies, the direction of the column heads of the first group of main unit bodies may be vertical to the direction of the column heads of the second group of main unit bodies. The distance between square surfaces in a same group of main unit bodies may be H1, wherein H1=8 mm, 16 mm, 24 mm or 32 mm. An accessory column head may be provided on the main unit bodies 1, the square surface where the accessory column head may be positioned may be vertical to the square surface where the column heads are positioned. The slot may be a gradual shrinkage hole with wider outside and narrower inside. The column head comprises a square column, a frustum and a cylinder through connection, wherein the square column may be vertically connected with the square surface, the square column may be connected with the cylinder through the frusta, the side length of the square column may be greater than the diameter of the cylinder; small particle double-row four-combined body are installed in the periphery of the frusta; The small-particle double-row four-combined body comprise four small main unit bodies which are connected in two lines and two rows; the small main unit bodies have the same shape and structure as those of the main unit bodies, and the dimension of the small main unit bodies may be one-half of that of the main unit bodies; the square hole enclosed by four main unit bodies are coordinated with the frusta, and the diameter of the cylinder may be equal to the diameter of the column head of the small unit bodies. A connecting shaft may be provided on one side of the main unit bodies, the axial line of the connecting shaft may be vertical to the axial line of the column head, a sphere may be provided on one side of the connecting shaft, a jack may be provided on the sphere, both the jack) and the slot are arranged on a same side, the spool of the connecting shaft respectively passes through the center of the sphere and the center of the main unit bodies, the connecting shaft, the sphere and the main unit bodies are mutually connected to constitute a Kadole shaft, wherein the diameter of the sphere may be less than or equal to the inscribed circle diameter of the main unit bodies. At least two spheres and two main unit bodies are provided on the Kadole shaft, adjacent two spheres are connected through a connecting shaft, two adjacent main unit bodies are connected through the corresponding square surfaces, the spheres and main unit bodies arranged on a same Kadole shaft have collinear center; at least two combined bodies are mounted on the Kadole shaft, and at least two combined bodies are connected and fixed into a complex; a square hole formed between two combined bodies may be coordinated with the connecting shaft between two spheres, so that the complex can rotate with the Kadole shaft (17) as axis while cannot slide along the length direction of the Kadole shaft. The steps of locking and connecting the third double-row four-combined body and another combined body are as follows: Firstly, coordinating the locating slot of the third double-row four-combined body with one main unit body on another combined body; then, respectively coordinating and connecting the second single-row two-combined body and the third single-row two-combined body with the third double-row four-combined body through column heads and slots, wherein the second single-row two-combined body and the third single-row two-combined body are arranged side by side on both sides of the second combined body; the second single-row two-combined body, the third single-row two-combined body and the third double-row four-combined body seize the second combined body; Finally, installing the first single-row two-combined body on the second single-row two-combined body and the third single-row two-combined body, where the first single-row two-combined body are respectively spliced with the main unit bodies on the same side of the second single-row two-combined body and the third single-row two-combined body.

The active effects of the present disclosure may include: models in various shapes can be assembled by using simple unit body components. In addition, various unit body components can be spliced and fixed, spliced in staggered manner and can be mutually snapped and locked, so that the asymmetric models and the models with bigger upper part and smaller lower part are even firmed and may not easily fall out; The present disclosure can enable the models to simultaneously extend in two orthogonal directions, so that the models comprising the whole toy block are even diversified. In addition, the locked structure can ensure greater firmness among various components of models and thus ensure that the model may not easily fall out in the process of movement or playing. Accessory column heads can be added on the unit bodies. The accessory column heads can increase the connecting directions of the unit body components and thus realize more diversified assembly modes, so that the assembled models are changeful in shapes and even firm. Grooves and insertion blocks can also be provided on the main unit bodies, so that the main unit bodies are spliced by inclination and form hollow three-dimensional models with higher interest. The design of the present disclosure may be even humanized. Complex components are designed for the children at age of 3 year below, and can enable the children to develop their space perception and creativity at earlier stage. The present disclosure may be also featured by such advantages as simple and compact structure, low manufacturing cost and convenient splicing.

Figure 1:
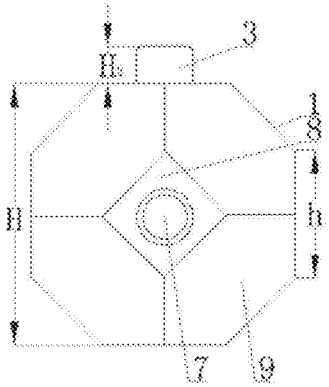
FIG. 1 is the structure diagram of the first kind of solution of the tetradecahedron toy block of the present disclosure.

Symbols in the attached drawings: 1 Main unit body 2. Slot 3. Column head 4. Inserting block 5 Groove 6 Locating slot 7 Accessory column head 8 Square surface 9 regular hexagon surface 10 Square hole 11 The first double-row four-combined body 12 The second double-row four combined body 13 Single-row four-combined body 14 Connecting shaft 15 Sphere 16 Jack 17 Kadole shaft 18 Square column 19 Frusta 20 Cylinder 21 Small-particle double-row four combined body 22 First single-row dual combined body 23 First single-row three-combined body 24 The second single-row two-combined body 25 The third single-row two-combined body 26 The third double-row four-combined body.

DETAILED DESCRIPTION

As shown in FIG. 1, the Tetradecahedron toy block disclosed in the present disclosure comprises a plurality of main unit bodies 1. In general, two or more main unit bodies 1 are provided. Several main unit bodies 1 have the same structure, shape and volume. Each main unit body 1 may include a Tetradecahedron having six square surfaces 8 and eight regular hexagon surfaces 9. Six square surfaces 8 are averagely divided into three groups, two square surfaces 8 in a same group are parallel, eight regular hexagon surfaces are averagely divided into four groups, two regular hexagon surfaces 9 in a same group are parallel, more than two main unit bodies are mutually spliced and/or fixedly connected to constitute a group; On each of main unit bodies 1, a column head 3 is provided on at least one of square surfaces 8; a slot 2 is provided on another square surface 8 which is positioned on the same axial line with the column head 3. The column head 3 and the slot 2 have the co-linear axial line. Furthermore, the axial line of the column head 3 is vertical to the square surface 8 where it is positioned. The column heads 3 of any two main unit bodies 1 are mutually coordinated with the slot 2, or the column heads 3 of any two group's unit bodies 1 are mutually coordinated with the slot 2. Several main unit bodies 1 can be connected end-to-end in turn through the column head 3 and the slot 2 to constitute a bar-shaped component. The quantity of the main bodies determines the length of the bar-shaped component. In the mode of parallel arrangement at the same level and vertical arrangement at different levels, several bar-shaped components can be spliced into various three-dimensional models. Furthermore, the adjacent component among different layers are mutually bit and locked, so that the three-dimensional models are even firm and stable. To facilitate the children to make disassembly and assembly of toy block while ensure that the column head 3 and the slot 2 are firmly spliced, the slot 2 is designed with a square hole or circular hole, the column head 3 can be designed as cylindrical plug or square column-shaped plug. The slot 2 with square hole is spliced with the cylindrical column head, or the slot 2 with circular hole is spliced with the square column-shaped column head. Such design can realize better splicing effect, not only facilitate firm splicing but also will not cause excessively tight connection and cause difficulty in disassembly by the children. The component may comprise two or more main unit bodies 1 in a same group through connection and fixation by means of the square surfaces 8 or the regular hexagon surfaces is a combined. The slots 2 of all the main unit bodies on the complex may face towards the same direction.

Figure 13:
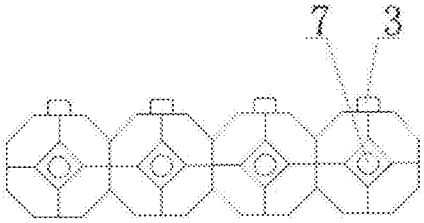
FIG. 13 is the structure diagram of the single-row four-combined body.
Figure 14:
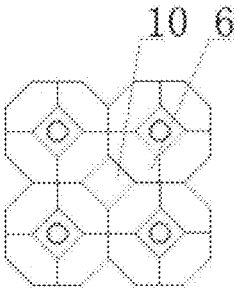
FIG. 14 is the structural diagram of the double-row four-combined body comprising four unit bodies through connection in two rows and two lines.
Figure 15:
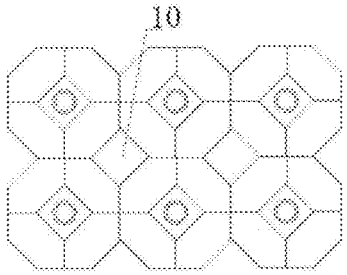
FIG. 15 is the structural diagram of a double-row six-combined body comprising six unit bodies through connection in two rows and three lines.

FIG. 13 shows a single-row four-combined body comprising four main unit bodies 1 through connection. As shown in FIG. 14, a complex comprises four main unit bodies 1 through connection in two rows and two lines. Two adjacent main unit bodies 1 are connected through the square surfaces 8. The column heads 3 and slots 2 of all the main unit bodies face toward the same direction and facilitate splicing and assembly. As shown in FIGS. 14 and 15, a locating slot 6 is enclosed by adjacent four main unit bodies 1, and a square hole 10 is provided in the center of the locating slot 6. In the process of assembly, the square hole 10 can provide storage space for the column head 3 of connected components so that the assembled model is more compact. Through the coordination between the column head 3 and the square hole 10, two groups of main unit bodies can be connected and fixed into an integral. Since the complex has big volume, it can be prevented from being swallowed by the children with smaller age. Furthermore, the complex can facilitate rapid assembly and provide more clear thinking way of splicing, so that the complex is more suitable for the children aged at 3~8.

Figure 16:
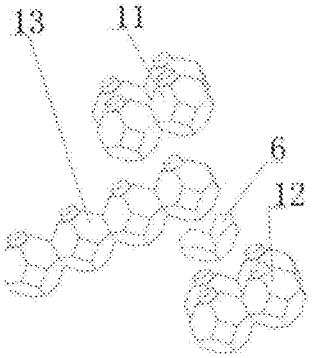
FIG. 16 is the assembly exploded view of two double-row four-combined bodies and one single-row four-combined body. To distinguish the shape of the locating slot in the Fig, the locating slot is drawn by dotted line.
Figure 17:
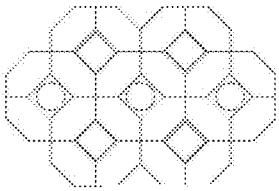
FIG. 17 illustrates the assembly of one double-row four-combined body with one single-row three-combined body; As shown in Fig, main plugs of two combined bodies are opposite in direction, and each main plug is connected and coordinated with the square hole.
Figure 18:
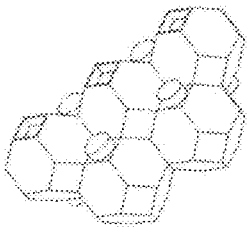
FIG. 18 is the stereogram of FIG. 18.
Figure 19:
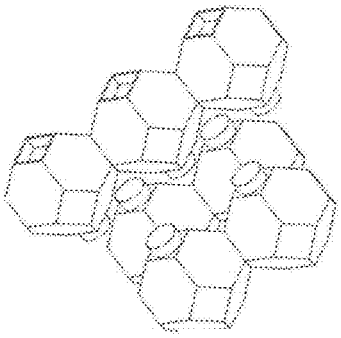
FIG. 19 is the exploded view of FIG. 18.
Figure 20:
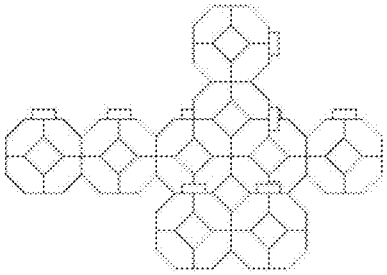
FIG. 20 shows a model comprising two double-row six-combined body, one single-row three-combined body and one single-row two combined body through assembly.
Figure 21:
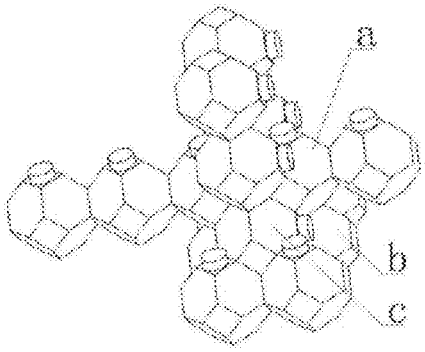
FIG. 21 is the stereogram of FIG. 20.
Figure 22:
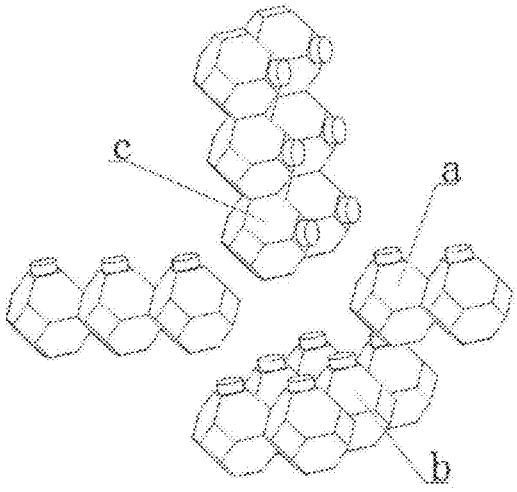
FIG. 22 is the exploded view of FIG. 21.
Figure 23:
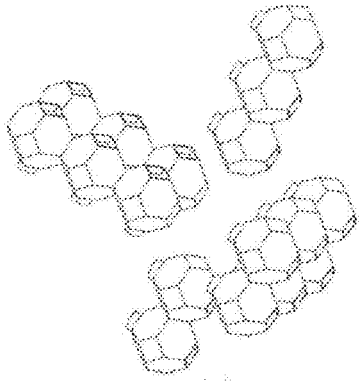
FIG. 23 is the exploded view of FIG. 21 from another angle.

The locating slot 6 is a slot enclosed by one square surface and four regular hexagon surfaces 9, the positioning slot 6 can be completely identical to the appearance of the main unit body. As shown in FIG. 16, two locating slots 6 of the first double-row four combined body 11 and the second double-row four combined body 12 can be coordinated up and down to constitute a cavity having the same appearance as the main unit body 1, thus these two locating slots can snap and lock the main unit bodies 1 on the single-row four-combined body 13. As a result, the single-row four combined body 13 can be fixed and locked with the first double-row four combined body 11 and the second double-row combined boy 12 into an integral, without need for being spliced with the first double-row four combined body 11 and the second double-row four combined body 12, and the efficiency of disassembly is effectively improved. To facilitate distinguish the three-dimensional shape of the locating slot 6, the profile of the locating slot 6 is drawn by using dotted line in FIG. 16. As shown in FIG. 15, six main unit bodies 1 are connected to constitute a complex with two rows and three lines, two adjacent main unit bodies 1 are connected through the square surfaces 8; The column heads 3 and slots 2 of all the main unit bodies 1 face toward the same direction. A locating slot 6 is enclosed by adjacent four main unit bodies 1, and a square hole 10 is provided at the center of the locating slot 6.

More than four main unit bodies 1 are connected into a group, wherein a locating slot 6 is enclosed by a central portion where every four main unit bodies 1 are mutually connected, a square hole 10 is provided in the center of the locating slot 6, the square hole 10 can be coordinated with any square surface 8 of the main unit body 1, so that the Tetradecahedron toy block extends in horizontal or longitudinal direction.

As shown in FIGS. 20~23, three groups of main unit bodies 1 are locked and coordinated. Both the first group of main unit bodies 1 and the second group of main unit bodies 1 are double-row six-combined body comprising six main unit bodies 1, the third group of main unit bodies 1 are single-row two-combined body comprising two main unit bodies, two main unit bodies 1 in the first group of main unit bodies 1 are coordinated with two locating slots 6 of the second group of main unit bodies 1 (namely, two main unit bodies 1 labeled as C are coordinated with two locating slots 6). The main unit body 1 labelled as b is the component constituting the locating slot 6. The main unit body 1 labeled as "a" in the third group of main unit bodies 1 is spliced and coordinated with the main unit body 1 labeled as "b" in the second group of main unit bodies 1 through column head and slot, so that the second group of main unit bodies 1 and the third group of main unit bodies 1 lock the first group of main unit bodies 1. The direction of the column head 3 of the first group of main unit bodies 1 may be vertical to the direction of the column head 3 of the second group of main unit bodies 1 so that the toy block can simultaneously extend in four directions (forward, backward, up and down), and the models comprising the whole toy block are more diversified. Furthermore, the locking structure can ensure that the connection between various components of model become even firm and the model will not easily fall out in the process of movement or playing.

To realize tighter locking among various groups of main unit bodies, it may be feasible to add the fourth group of main unit bodies 1. The fourth group of main unit bodies are single-row three-combined body comprising three main unit bodies; the fourth group of main unit bodies 1 and the third group of main unit bodies are respectively positioned on both sides of the first group of main unit bodies 1, and both are spliced and coordinated with the second group of main unit bodies; the third group of main unit bodies 1 and the fourth group of main unit bodies 1 are jointly coordinated with the second group of main unit bodies 1 to lock the first group of main unit bodies 1.

To realize more diversified assembly modes and more delicate models, the distance between the square surfaces 8 in a same group of main unit bodies 1 is designed as H1, wherein H1=8 mm, 16 mm, 24 mm or 32 mm. The main unit bodies with three dimensions can be used in coordination.

To ensure the firm splicing between the column head 3 and the slot 2 and also facilitate the children in making disassembly, the height of the column head 3 is designed as H2, wherein H2=2 mm-10 mm.

As shown in FIGS. 1 and 13, an accessory column head 7 is provided on the main unit body 1, the square surface 8 where the accessory column head 7 is positioned is vertical to the square surface 8 where the column head 3 is positioned. The main unit body 1 provided with the accessory column head 7 can be used as a bending direction connecting piece and can enable the assembled model to realize the relative rotation among multiple components. For example, the main unit body 1 provided with the accessory column head 7 can be used as the joint of assembled robot to realize the multidirectional rotation of arm or leg, so that the model may be more realistic.

Figure 2:
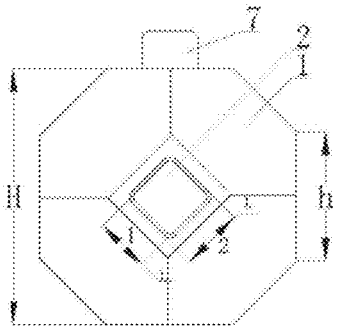
FIG. 2 is the bottom view of FIG. 1.
Figure 3:
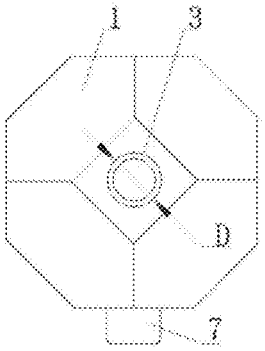
FIG. 3 is the top view of FIG. 1.
Figure 4:
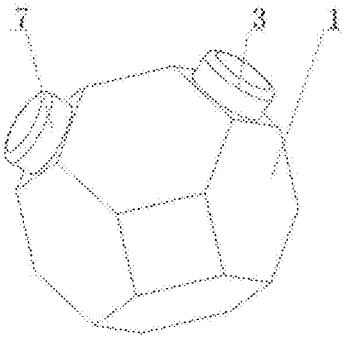
FIG. 4 is the stereogram of FIG. 1.
Figure 5:
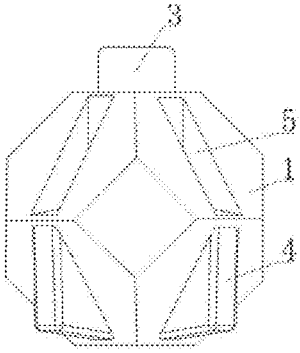
FIG. 5 is the structural diagram of the second kind of solution of the tetradecahedron toy block disclosed in the present disclosure.
Figure 6:
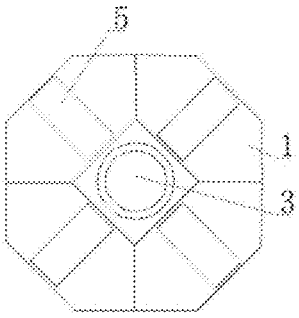
FIG. 6 is the top view of FIG. 5.
Figure 7:
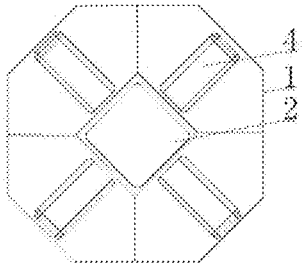
FIG. 7 is the bottom view of FIG. 5.
Figure 8:
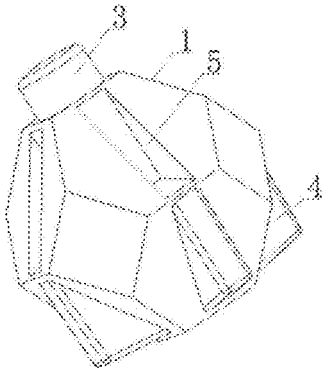
FIG. 8 is the stereogram of FIG. 5.
Figure 9:
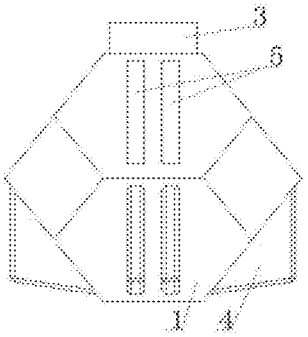
FIG. 9 is the structure diagram of the second solution of the tetradecahedron toy block of the present disclosure.
Figure 10:
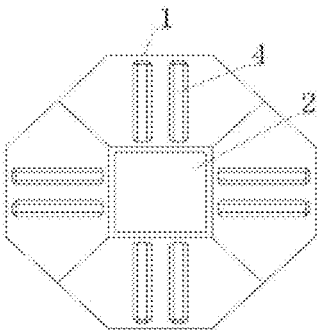
FIG. 10 is the bottom view of FIG. 9.
Figure 11:
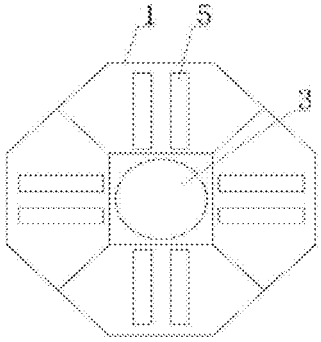
FIG. 11 is the top view of FIG. 9.
Figure 12:
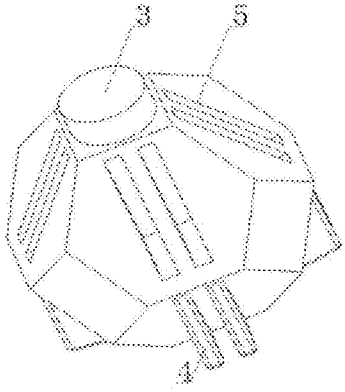
FIG. 12 is the stereogram of FIG. 9.

To further realize firm coordination between the slot 2 and the column head 3 and also facilitate the children to insert the column head 3 into the slot 2, as shown in FIG. 2, the slot 2 is designed as gradual shrinkage hole with wider outside and narrower inside. The slot 2 in this solution can play guiding function for the column head 3, so that the splicing may be more convenient and rapid.

As shown in FIGS. 5-8, on four regular hexagon surfaces 9 being close to the column head 3 of the main unit bodies 1, it may be feasible to respectively open a groove 5; On four regular hexagon surfaces 9 being close to the slot 2, it may be feasible to respectively provide an inserting block 4. Four grooves 5 and four inserting blocks 4 have one-to-one correspondence relation, namely one groove 5 on every two adjacent regular hexagon surfaces 9 corresponds to one inserting block 4. Two main unit bodies 1 can not only be spliced in straight direction through the slot 2 and the column head 3, and can also be spliced in inclined direction through the inserting block 4 and the groove 5. Therefore, by merely using the main unit bodies 1 of this solution, it may be feasible to assemble various hollow three-dimensional models with better stability. As shown in FIGS. 5-8, the main unit bodies with groove 5 and inserting block 4 can be spliced and coordinated with the combined body through column head and slot; it may be also feasible to use the groove 5 and inserting block 4 as he connecting piece to realize the splicing of model in inclined direction, thus further increasing the shape variations of models and also ensuring the firmness of models. Two or more main unit bodies can connect and fix the formed combined body through the regular hexagon surfaces 9. The inserting block 4 can be cylindrical, and the groove 5 can be a circular hole.

To further enhance the inclined firmness between two main unit bodies 1, as shown in FIGS. 9-12, on four regular hexagon surfaces 9 being close to the column head 3 of the main unit bodies 1, two grooves 5 are respectively provided; on four regular hexagon surfaces 9 being close to the inserting block 2, two inserting blocks 4 are respectively provided; eight grooves 5 and eight inserting blocks 4 have one-to-one correspondence relation.

Figure 30:
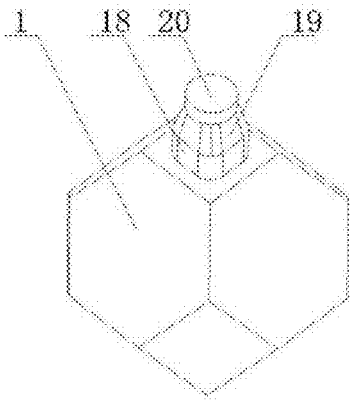
FIG. 30 is the structure diagram of another main unit body, wherein the column head comprises a square column 18, a frusta 19 and a cylinder 20 through connection.
Figure 31:
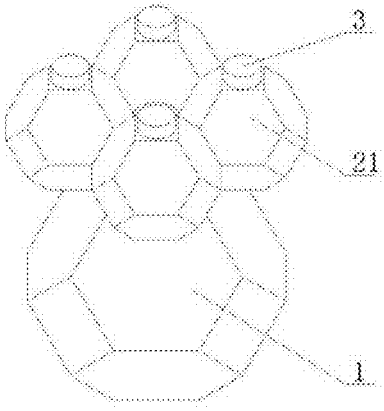
FIG. 31 is the structural diagram where the main unit body as shown in FIG. 30 is coordinated with the small-particle double-row four combined body 21.
Figure 32:
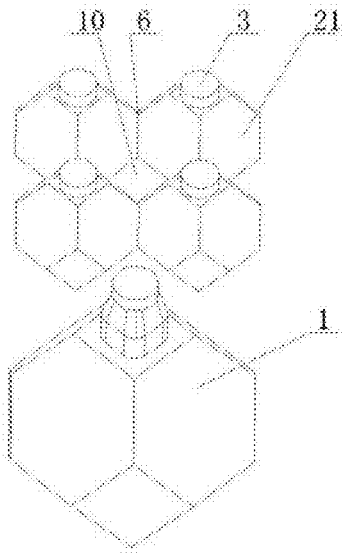
FIG. 32 is the exploded view of FIG. 31.

To realize the coordination and connection between main unit bodies with different dimensions and increase more assembly methods and thus assemble more diversified and vivid models, as shown in FIG. 30, the column head 3 comprises a square column 18, a frustum 19 and a cylinder 20 through connection, wherein the square column 18 is vertically connected with the square surface 8, the square column 18 is connected with the cylinder 20 through the frusta (19), the side length of the square column 18 may be greater than the diameter of the cylinder 20; the diameter of the cylinder 20 is equal to the column head diameter of small main unit body; small particle double-row four combined body 21 is installed in the periphery of the frusta 19; The small-particle double-row four-combined body 21 comprises four small main unit bodies which are connected in two lines and two rows; the small main unit bodies have the same shape and structure as those of the main unit bodies 1, and the dimension of the small main unit bodies is one-half of that of the main unit bodies 1; the square hole 10 enclosed by four small main unit bodies are coordinated with the frusta 19, so that the small-particle double-row four-combined body 21 is spliced and fixed with the main unit bodies 1. At the same time, the square column 18 and the cylinder 20 can be coordinated with 6 of small-particle double-row four-combined bodies 21, so that the small-particle double-row four-combined body 21 and the main unit bodies 1 may not easily generate relative swing.

Figure 24:
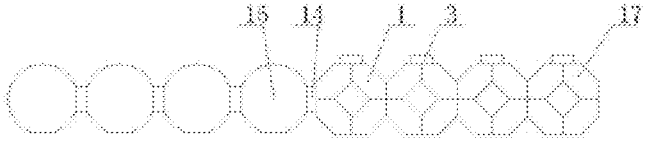
FIG. 24 is the structural diagram of the Kadole shaft 17.
Figure 25:
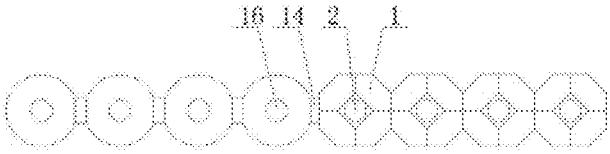
FIG. 25 is the upward view structural diagram of FIG. 24.
Figure 26:
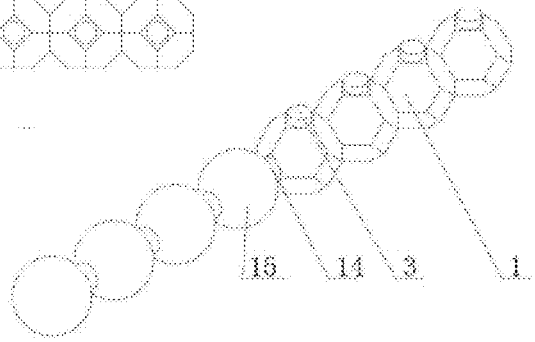
FIG. 26 is the spatial structure diagram of FIG. 24.

As shown in FIG. 24, a connecting shaft 14 is provided on one side of the main unit bodies, the axial line of the connecting shaft 14 is vertical to the axial line of the column head 3, a sphere 15 is provided on one side of the connecting shaft 14, a jack 16 is provided on the sphere 15; both the jack 16 and the slot 2 are arranged on a same side so that the sphere 15 and the main unit bodies 1 can be spliced and coordinated in synchronization with the other main unit bodies 1. The spool of the connecting shaft 14 respectively passes through the center of the sphere 15 and the center of the main unit bodies 1; The connecting shaft 14, the sphere 15 and the main unit bodies 1 are mutually connected to constitute a Kadole shaft 17, namely, the Kadole shaft 17 comprises the connecting shaft 14, the sphere 15 and the main unit bodies through connection. The Kadole shaft 17 can also include one main unit body 1 and at least two spheres 15 through connection, and any two adjacent spheres 15 are connected through the connecting shaft 14. The diameter of the sphere 15 may be less than or equal to the inscribed circle diameter of the Tetradecahedron of the main unit bodies 1.

Figure 27:
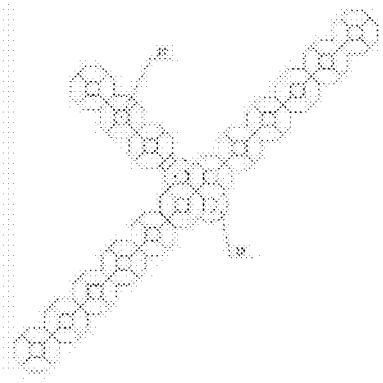
FIG. 27 is the structural diagram, where the Kadole shaft 17 is coordinated with two single-row seven-combined bodies, a complex comprises two single-row seven combined bodies spliced through column head and slot; a square hole comprising two single-row seven combined bodies is coordinated with the connecting shaft 14 of the Kadole shaft.
Figure 28:
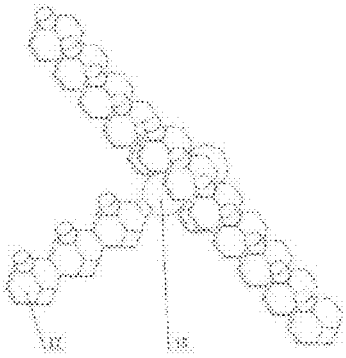
FIG. 28 is the stereogram structure diagram of FIG. 27.
Figure 29:
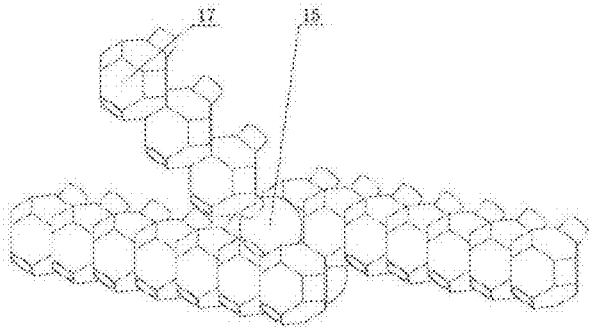
FIG. 29 is the stereogram structure diagram of FIG. 27 from another angle.

As shown in FIG. 27, at least two spheres 15 and two main unit bodies 1 are provided on the Kadole shaft 17, adjacent two spheres 15 are connected through a connecting shaft 14, two adjacent main unit bodies 1 are connected through the corresponding square surfaces 8, the spheres 15 and main unit bodies 1 on a same Kadole shaft 17 have collinear center; at least two combined bodies are mounted on the Kadole shaft 17, and at least two combined bodies are connected and fixed into a complex; a square hole 10 formed between two combined bodies is coordinated with the connecting shaft 14 between two spheres 15, so that the complex can rotate with the Kadole shaft 17 as axis while cannot slide along the length direction of the Kadole shaft 17. The Kadole shaft 17 can act as the wheel axle of such models as windmill, Ferris wheel and automobile.

Figure 33:
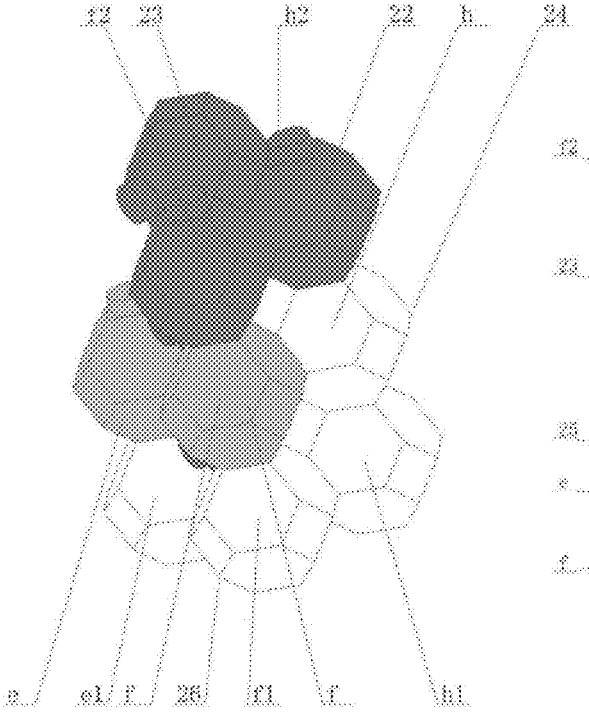
FIG. 33 is the schematic diagram of the locking and connecting method.
Figure 34:
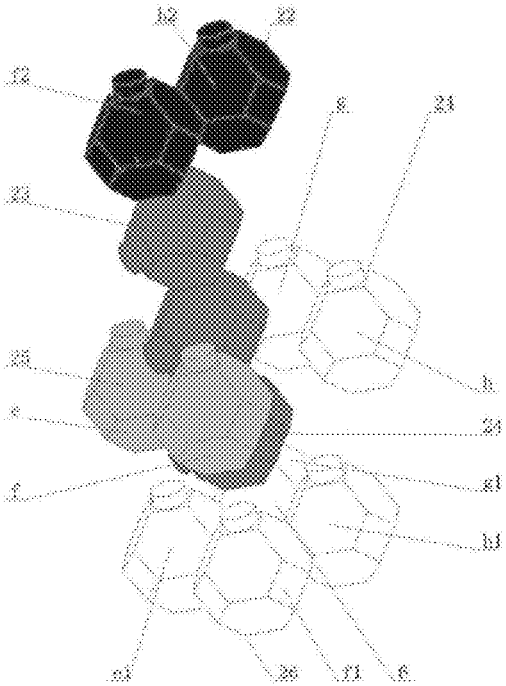
FIG. 34 is the exploded view of FIG. 33.
Figure 35:
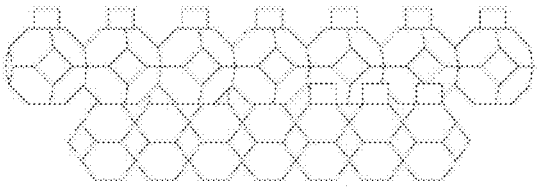
FIG. 35 shows a locating shaft mechanism comprising two single-row seven combined bodies spliced through central slot and column head.
Figure 37:
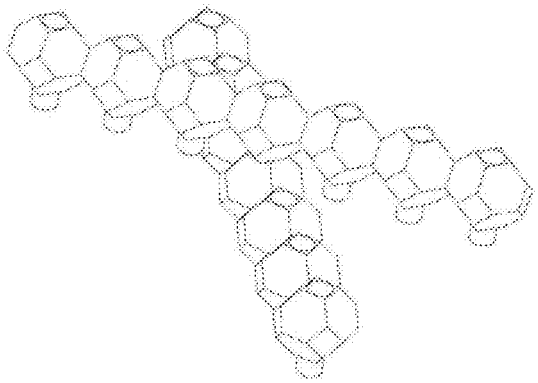
FIG. 37 is the spatial structure diagram of FIG. 35 from another angle.
Figure 36:
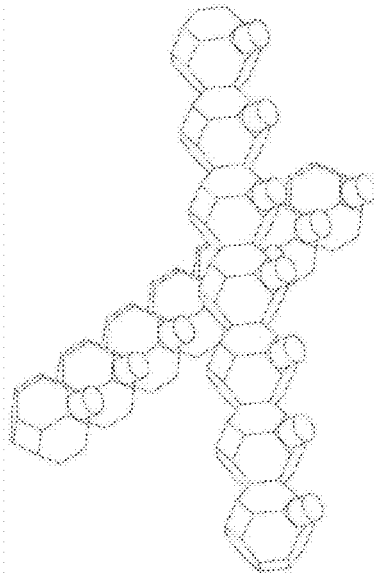
FIG. 36 is the stereogram structure diagram of FIG. 35.
Figure 38:
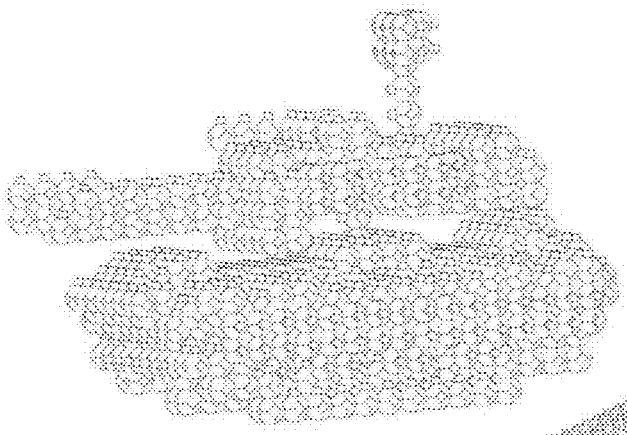
FIG. 38 is the operating status diagram where the unit bodies are assembled into a tank.
Figure 39:
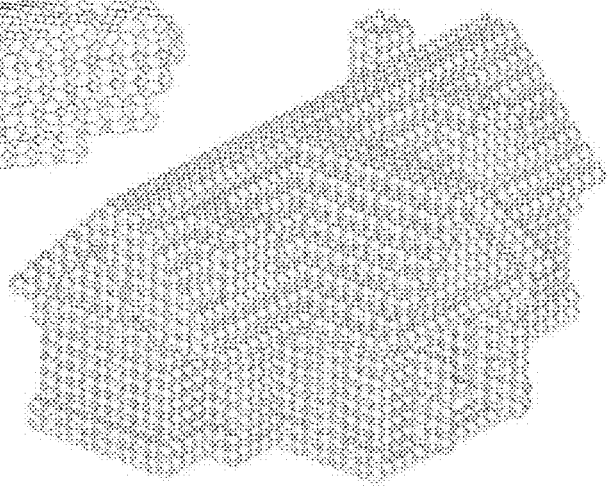
FIG. 39 is the operating status diagram where the unit bodies are assembled into a house.
Figure 40:
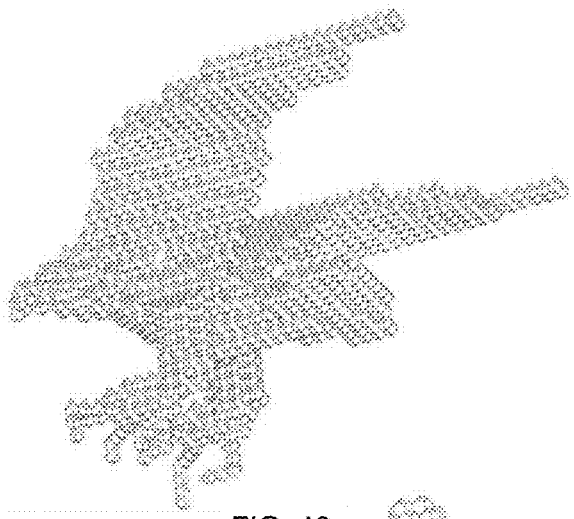
FIG. 40 is the operating status diagram where the unit bodies are assembled into an eagle.
Figure 41:
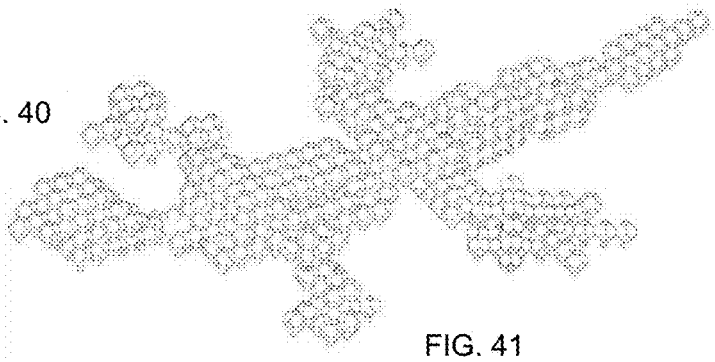
FIG. 41 is the operating status diagram where the unit bodies are assembled into a lizard.
Figure 42:
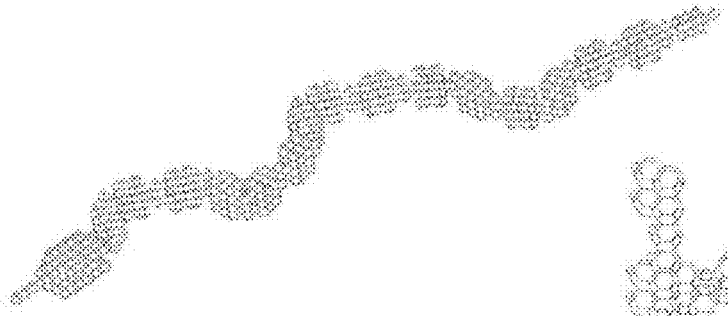
FIG. 42 is the operating status diagram where the unit bodies are assembled into a snake.
Figure 43:
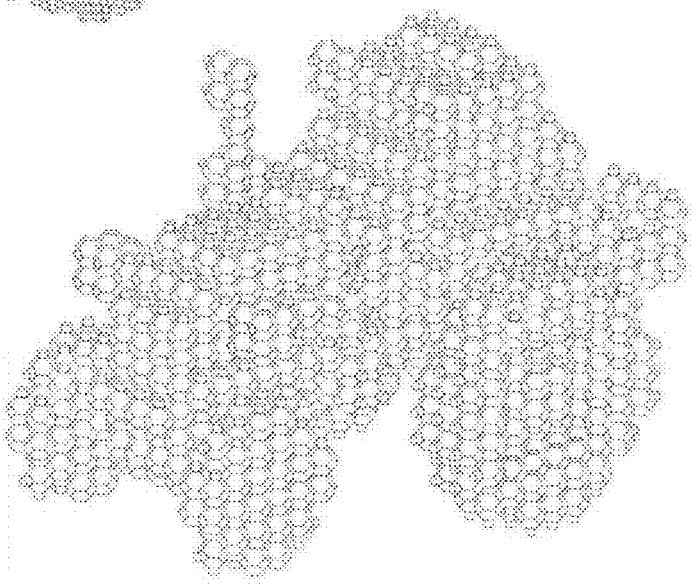
FIG. 43 is the operating status diagram where the unit bodies are assembled into a tractor.
Figure 44:
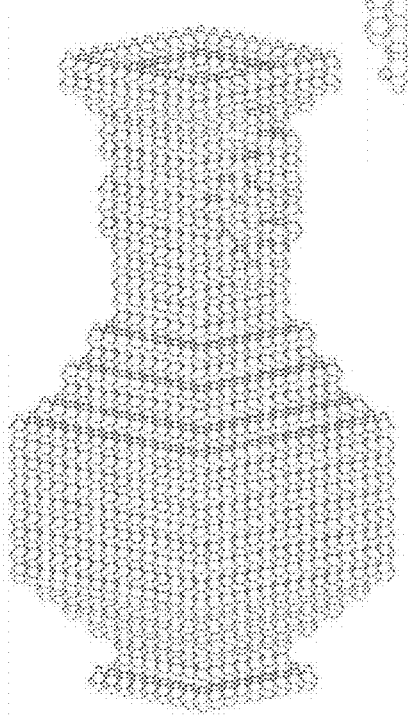
FIG. 44 is the operating status diagram where the unit bodies are assembled into a Blue and White Porcelain-ware.
Figure 45:
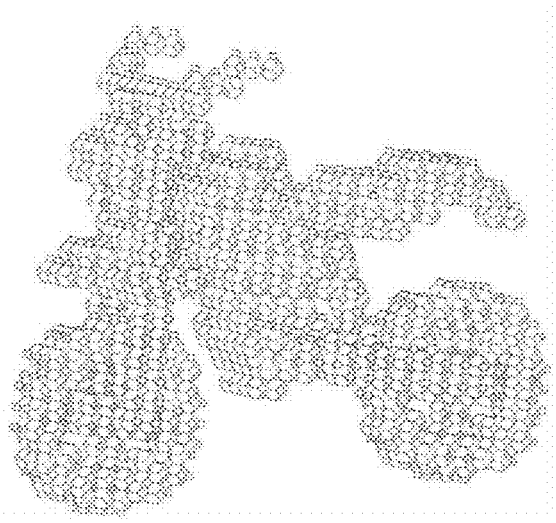
FIG. 45 is the operating status diagram where the unit bodies are assembled into a motorcycle.
Figure 46:
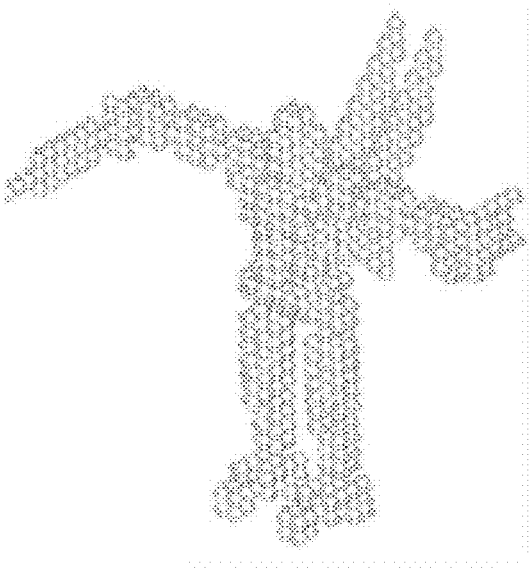
FIG. 46 is the operating status diagram where the unit bodies are assembled into a robot.
Figure 47:
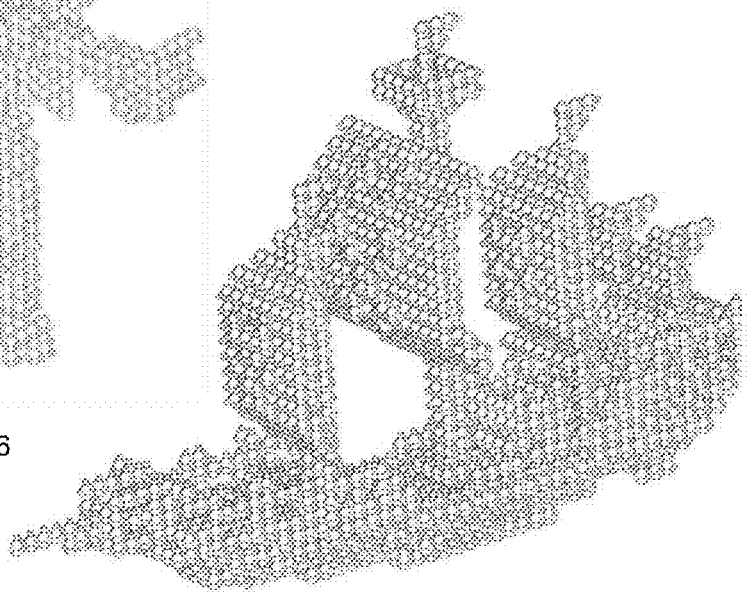
FIG. 47 is the operating status diagram where the unit bodies are assembled into a sea rover.
Figure 48:
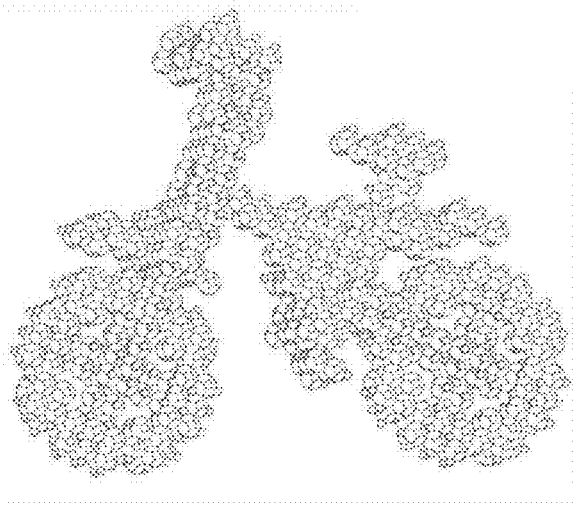
FIG. 48 is the operating status diagram where the unit bodies are assembled into a bicycle.
Figure 49:
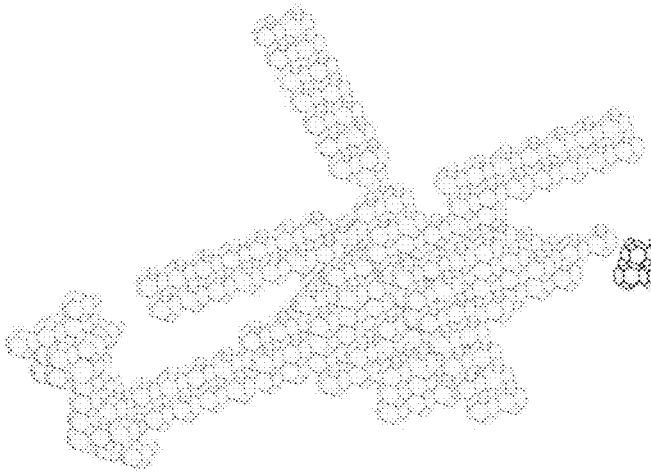
FIG. 49 is the operating status diagram where the unit bodies are assembled into a helicopter.
Figure 50:
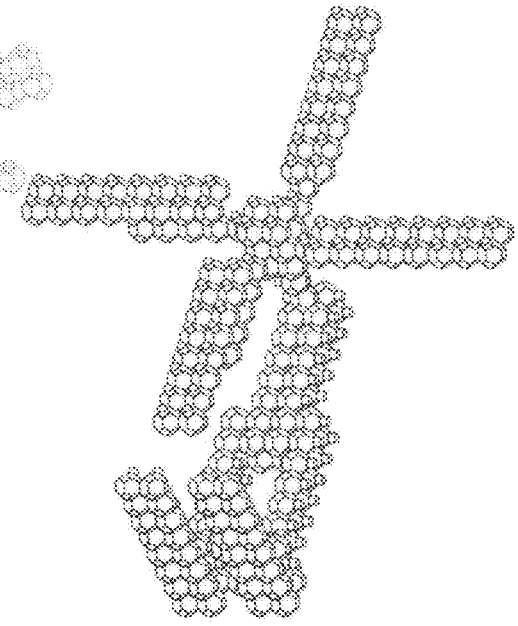
FIG. 50 is the operating status diagram where the unit bodies are assembled into a windmill.
Figure 51:
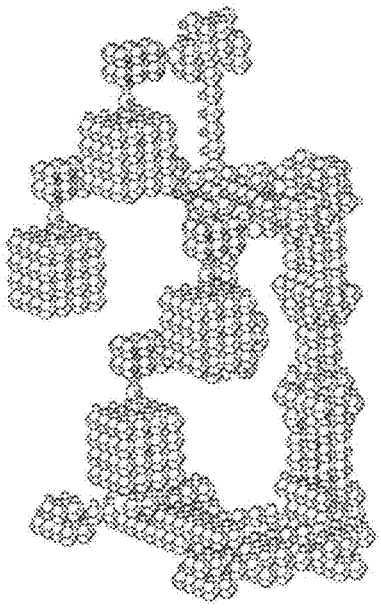
FIG. 51 is the operating status diagram where the unit bodies are assembled into a Ferris wheel.
Figure 52:
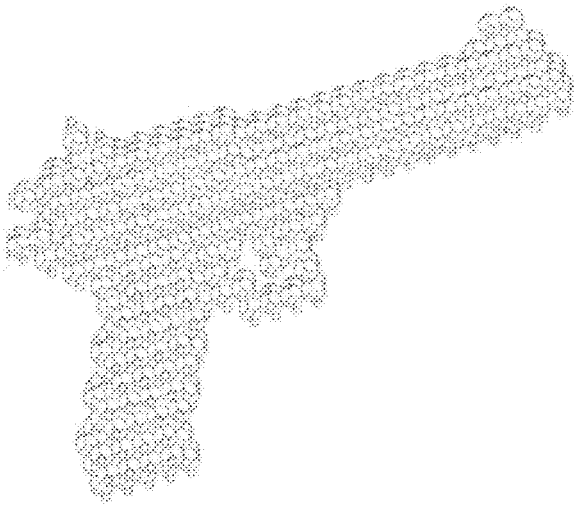
FIG. 52 is the operating status diagram where the unit bodies are assembled into a pistol.

As shown in FIGS. 33 and 34, the steps of locking and connecting the third double-row combined bodies 26 with another combined body include: Firstly coordinating the locating slot 6 of the third double-row four-combined body 26 with one main unit body on another combined body; then, respectively coordinating and connecting the second single-row two-combined body 24 and the third single-row two combined body 25 with the third double-row four combined body 26 through column head and inserting slot, the second single-row two-combined body 24 and the third single-row two combined body 25 are arranged side by side on both sides of the second combined body; the second single-row two-combined body 24, the third single-row two-combined body 25 and the third double-row four-combined body 26 seize the second combined body; finally, installing the first single-row double-combined body 22 on the second single-row two-combined body 24 and the third single-row two combined body 25, wherein the first single-row double-combined body 22 is respectively spliced with the main unit bodies 1 on the same side of the second single-row two-combined body 24 and the third single-row two-combined body 25. The method for locking and connecting can enable the connection between various combined bodies to become even tight and also enable the column head of the combined body to face towards vertical direction, so as to realize the extension of model in horizontal and vertical directions.

As shown in FIGS. 33 and 34, the first single-row three-combined body 23 and the third double-row four-combined body 26 are locked and connected through the first single-row double-combined body 22, the second single-row two-combined body 24 and the third single-row two-combined body 25, and the connecting steps are as follows: Firstly coordinating the first single-row three-combined body 23 in vertical state with the third double-row four-combined body 26 in horizontal state, so that one main unit body 1 at the lower end of the first single row three-combined body 23 is coordinated with the square hole 10 of the third double-row four-combined body 26; as shown in FIG. 34, respectively connecting the second single-row two-combined body 24 and the third single-row two-combined body 25 with the third double-row four-combined body 26 through column head and slot, namely, the main unit bodies g and h of the second single-row two-combined body 24 are respectively spliced an coordinated with the main unit bodies g1 and h1 of the third double-row four combined body 26, the main unit bodies e and f of the third single-row two combined bodies 25 are respectively spliced and coordinated with e1 and f1 of the third double-row four combined bodies 26, the second single-row two-combined body 24, the third single-row two combined body 25 and the third double-row four-combined body 26 seize the first single-row three-combined body 23; To ensure even firm connection, using 22 to splice and coordinate the second single-row two-combined body 24 and the third single-row two-combined body 25 to realize locking, namely, the main unit bodies h2 and f2 of 22 are respectively spliced and coordinated with the main unit body h of the second single-row two combined body 24 and the main unit body f of the third single-row two-combined body 25.

The technical solutions disclosed in the present disclosure are not limited to the range of the embodiments of the present disclosure. All the technical contents which are not described in detail in the present disclosure fall within prior art.

What is claimed is:

1. A device for one or more toy blocks, the device comprising a plurality of main unit bodies each having a same structure, a same shape and a same volume, wherein:

each of the plurality of main unit bodies is a tetradecahedron having six square surfaces and eight regular hexagon surfaces, the six square surfaces are averagely divided into three groups, two square surfaces in a group of the three groups are parallel, the eight regular hexagon surfaces are averagely divided into four groups, two regular hexagon surfaces in a group of the four groups are parallel, more than two main unit bodies are mutually spliced or fixedly connected to constitute a group, or a combination thereof, a column head is located on at least one of square surfaces on each of main unit bodies, the column head is located on a same axis of another square surface, column heads of each of two main unit bodies are mutually coordinated with a slot, or the column heads of each of two groups of main unit bodies are mutually coordinated with a slot, a component comprises two or more main unit bodies of the plurality of main unit bodies in a same group through connection and fixation that comprises a combined body, and wherein the column head comprises a square column, a frustum and a cylinder through connection, the square column is vertically connected with the square surface, the square column is connected with the cylinder through the frusta, the side length of the square column is greater than the diameter of the cylinder; small particle double-row four combined body are installed in the periphery of the frusta, the small-particle double-row four combined body comprises four small main unit bodies which are connected in two lines and two rows, the small main unit bodies have the same shape and structure as those of the main unit bodies, and the dimension of the small main unit bodies is one-half of that of the main unit bodies, and the square hole enclosed by four main unit bodies are coordinated with the frusta, and the diameter of the cylinder is equal to the diameter of the column head of the small unit bodies.

2. The device of claim 1, wherein more than four main unit bodies of the plurality of main unit bodies are connected into a group, a locating slot is enclosed by a central portion where every four main unit bodies of the plurality of main unit bodies are mutually connected, a square hole is located in a center of the locating slot, and a square hole is coordinated with each of the square surface of a main unit body of the plurality of main unit bodies such that the device extends along a horizontal or longitudinal direction.

3. The device of claim 2, wherein one or more first main unit bodies of the plurality of main unit bodies are locked and coordinated with one or more second main unit bodies of the plurality of main unit bodies through one or more third maim unit bodies of the plurality of main unit bodies, the one or more first main unit bodies are coordinated with a locating slot of the one or more second main unit bodies, a direction of column heads of the one or more first main unit bodies is vertical to or parallel with a direction of the column heads of the one or more second main unit bodies, and the one or more third main unit bodies is spliced and coordinated with a slot through column heads so that the one or more second main unit bodies and the one or more third main unit bodies are respectively coordinated with the one or more first main unit bodies to lock the one or more first main unit bodies.

4. The device of claim 3, wherein one or more fourth main unit bodies of the plurality of main unit bodies are spliced and coordinated with a slot through column heads, the one or more fourth main unit bodies and one or more third main unit bodies are respectively positioned on both sides of the one or more first main unit bodies, and the one or more third main unit bodies, the one or more fourth main unit bodies and the one or more second main unit bodies are jointly coordinated with the one or more first main unit bodies to lock the one or more first main unit bodies.

5. The device of claim 4, wherein both the first one or more main unit bodies and the second one or more main unit bodies are double-row six-combined bodies comprising six main unit bodies, the third one or more main unit bodies are single-row two-combined body comprising two main unit bodies, two main unit bodies in the first one or more main unit body are coordinated with two locating slots of the second one or more main unit bodies, the third one or more main unit bodies are spliced and coordinated with the second one or more main unit bodies, the second one or more main unit bodies and the third one or more main unit bodies lock the first one or more main unit bodies, and a direction of column heads of the first one or more main unit bodies is vertical to a direction of column heads of the second one or more main unit bodies.

6. The device of claim 4, wherein a distance between square surfaces in a same group of main unit bodies of the plurality of main unit bodies is about 8 millimeter (mm), 16 mm, 24 mm or 32 mm.

7. The device of claim 4, wherein an accessory column head is provided on each main unit body of the plurality of main unit bodies, and the square surface where the accessory column head is positioned is vertical to the square surface where the column heads are positioned.

8. The device claim 4, wherein the slot is a gradual shrinkage hole with a wider outside and a narrower inside.

9. The device of claim 3, wherein a distance between square surfaces in a same group of main unit bodies of the plurality of main unit bodies is about 8 millimeter (mm), 16 mm, 24 mm or 32 mm.

10. The device of claim 3, wherein an accessory column head is provided on each main unit body of the plurality of main unit bodies, and the square surface where the accessory column head is positioned is vertical to the square surface where the column heads are positioned.

11. The device claim 3, wherein the slot is a gradual shrinkage hole with a wider outside and a narrower inside.

12. The device of claim 2, wherein a distance between square surfaces in a same group of main unit bodies of the plurality of main unit bodies is about 8 millimeter (mm), 16 mm, 24 mm or 32 mm.

13. The device of claim 2, wherein an accessory column head is provided on each main unit body of the plurality of main unit bodies, and the square surface where the accessory column head is positioned is vertical to the square surface where the column heads are positioned.

14. The device claim 2, wherein the slot is a gradual shrinkage hole with a wider outside and a narrower inside.

15. The device of claim 1 wherein a distance between square surfaces in a same group of main unit bodies of the plurality of main unit bodies is about 8 millimeter (mm), 16 mm, 24 mm or 32 mm.

16. The device of claim 1, wherein an accessory column head is provided on each main unit body of the plurality of main unit bodies, and the square surface where the accessory column head is positioned is vertical to the square surface where the column heads are positioned.

17. The device of claim 1, wherein the slot is a gradual shrinkage hole with a wider outside and a narrower inside.

18. A method for locking and connecting the device of claim 1, the method comprising:

locking and connecting a third double-row four-combined body and another combined body by:

coordinating a locating slot of the third double-row four-combined body with one main unit body of the plurality of main unit bodies on the other combined body, respectively coordinating and connecting a second single-row two-combined body and a third single-row two-combined body with the third double-row four-combined body through column heads and slots, wherein the second single-row two-combined body and the third single-row two-combined body are arranged side by side on both sides of the second combined body, and the second single-row two-combined body, the third single-row two-combined body and the third double-row four-combined body seize the second combined body, and installing the first single-row two-combined body on the second single-row two-combined body and the third single-row two-combined body, where the first single-row two-combined body are respectively spliced with the main unit bodies on the same side of the second single-row two-combined body and the third single-row two-combined body.

19. A device for one or more toy blocks, the device comprising a plurality of main unit bodies each having a same structure, a same shape and a same volume, wherein:

each of the plurality of main unit bodies is a tetradecahedron having six square surfaces and eight regular hexagon surfaces, the six square surfaces are averagely divided into three groups, two square surfaces in a group of the three groups are parallel, the eight regular hexagon surfaces are averagely divided into four groups, two regular hexagon surfaces in a group of the four groups are parallel, more than two main unit bodies are mutually spliced or fixedly connected to constitute a group, or a combination thereof, a column head is located on at least one of square surfaces on each of main unit bodies, the column head is located on a same axis of another square surface, column heads of each of two main unit bodies are mutually coordinated with a slot, or the column heads of each of two groups of main unit bodies are mutually coordinated with a slot, a component comprises two or more main unit bodies of the plurality of main unit bodies in a same group through connection and fixation that comprises a combined body, and wherein a connecting shaft is located on one side of the main unit bodies, the axial line of the connecting shaft is vertical to the axial line of the column head, a sphere is provided on one side of the connecting shaft, a jack is provided on the sphere, both the jack and the slot are arranged on a same side, the spool of the connecting shaft respectively passes through the center of the sphere and the center of the main unit bodies, and the connecting shaft, the sphere and the main unit bodies are mutually connected to constitute a shaft, a diameter of the sphere is less than or equal to the inscribed circle diameter of the main unit bodies.

20. The device of claim 19, wherein at least two spheres and two main unit bodies of the plurality of main unit bodies are located on the shaft, adjacent two spheres are connected through a connecting shaft, two adjacent main unit bodies are connected through the corresponding square surface, the spheres and main unit bodies on a same shaft have collinear center; at least two combined bodies are mounted on the shaft, and at least two combined bodies are connected and fixed into a complex, and a square hole formed between two combined bodies is coordinated with the connecting shaft between two spheres such that the complex rotates with the shaft as axis while stop sliding along the length direction of the shaft.

* * * * *